United States Patent [19]

Cheung

[11] 4,015,643

[45] Apr. 5, 1977

[54] TENSIONING TOOL WITH SELF-ENERGIZING GRIPPER PLUG

[75] Inventor: Nelson Cheung, Arlington Heights, Ill.

[73] Assignee: Signode Corporation, Glenview, Ill.

[22] Filed: Jan. 21, 1976

[21] Appl. No.: 651,199

[52] U.S. Cl. ..... 140/93.4; 140/123.5; 100/32; 254/51

[51] Int. Cl.² ..... B21F 9/02

[58] Field of Search ..... 140/93 A, 93.2, 93.4, 140/123.5, 123.6; 100/32; 254/51

[56] References Cited

UNITED STATES PATENTS

| | | | |
|---|---|---|---|
| 3,169,011 | 2/1965 | Rutty | 254/51 |
| 3,360,017 | 12/1967 | Vilcins | 254/51 |
| 3,367,374 | 2/1968 | Meier et al. | 140/123.5 |
| 3,648,739 | 3/1972 | Angarola | 140/123.6 |

*Primary Examiner*—Lowell A. Larson
*Attorney, Agent, or Firm*—Dressler, Goldsmith, Clement, Gordon & Shore, Ltd.

[57] ABSTRACT

A strapping tool having a resiliently biased feed wheel and a gripper plug in the base thereof. The feed wheel is movable relative to the gripper plug to permit loading and releasing of overlapping loop strap ends therebetween. The gripper plug has a concave gripping surface and is pivotally mounted in the base of the tensioning tool with the pivotal axis parallel to the axis of the feed wheel, thus permitting rotation of the gripper plug about its pivotal axis under the influence of the force on the overlapped strap ends during the tensioning action by the feed wheel. The interaction between the feed wheel surface and the concave gripping surface of the gripper plug distributes the impressed force therebetween uniformly over the segment of the overlapping strap ends lying between the two surfaces to preclude pinching of the strap.

8 Claims, 5 Drawing Figures

26
16
10
18
22
24
17
12
C
20
30
38
32
36
28
U
S
14R
14
34
40
14F
L
P

TENSIONING TOOL WITH SELF-ENERGIZING GRIPPER PLUG

BACKGROUND OF THE INVENTION

Strap tensioning tools employed in connection with securing a tensioned strap loop around a package or other object are commonly of the type wherein overlapping ends of the strap loop are engaged respectively by a feed wheel and an adjacent base mounted gripper plug. Rotation of the feed wheel advances one strap end while the gripper plug holds the other strap end stationary to tighten the strap loop about a package. Both metallic and non-metallic (e.g., plastic) strap are in use with this type of tool.

In a common type of strap tensioning tool currently employed, the feed wheel is mounted from a main frame for bodily movement toward and away from the base portion to load and to release the overlapping strap ends. Normally, this feed wheel is swingably mounted to approach a base mounted gripper plug to provide a relative movement between the feed wheel and gripper plug.

As tension is drawn on the strap by rotation of the feed wheel, a force must be maintained on both of the overlapping strap ends by the gripper plug and feed wheel as the strap contacting the feed wheel is drawn alongside the strap contacting the gripper plug. The force causes the surface of the feed wheel and gripper plug to be impressed into the strap surfaces thereby providing a frictional gripping action. However, too much force over a small area can cause the strap ends to be too deeply penetrated by the surface of the feed wheel and gripper plug creating a severe deformation of the strap ends that can induce premature fracture of the strap. This problem can be aggravated if the surfaces of the feed wheel and gripper plug are rough or toothed, since the tips of some of the teeth can more easily puncture the strap. Thus, in the strapping art, it would be highly desirable if the strapping tool were to apply the biasing force on the overlapping strap ends between the feed wheel and gripper plug uniformly, so that no uneven points of pressure are exerted on a portion of the strap to produce too deep a penetration of the strap which might fracture the strap at the weakened pinch area.

SUMMARY OF THE INVENTION

The instant invention is used in a strapping tool having a strap feed wheel mounted from a main frame above the base of the tool. The strap feed wheel has a predetermined radius of curvature and is rotated in one direction. The gripper plug is located in the base below the feed wheel and has a concave gripping surface. The feed wheel and gripper plug are arranged to receive overlapping ends of the strap loop. The relative space between the feed wheel surface and gripper plug surface can be varied to permit loading and releasing of the overlapping loop strap ends.

For initially loading the tool, the feed wheel is moved away from the gripper plug to permit the overlapping loop strap ends to be inserted therebetween. After the strap ends are loaded between the feed wheel and gripper plug, a biasing force maintains the gripper plug and feed wheel against the overlapping ends. The feed wheel is rotated to draw the strap end contacting the feed wheel in a loop tightening direction.

In accordance with the invention, the gripper plug is pivotally mounted in the base location with the pivotal axis parallel to the axis of the feed wheel. This permits rotation of the gripper plug about the pivotal axis under the influence of the force on the overlapped strap ends during the tensioning action of the feed wheel. Thus, in this invention the interaction between the feed wheel surface and the concave gripping surface of the gripper plug permits the gripper plug to rotate on an axis whereby the concave gripping surface is presented to conform to the location and outer surface of the feed wheel. As a result, a uniformly distributed force is impressed upon the overlapping strap ends that lie between the feed wheel and gripper plug surfaces. This prevents the formation of pinch points on the strap that are experienced with stationary positioned gripper plugs. The uniformly distributed force impressed upon the overlapping strap ends thus allows higher tensioning since the strap is less likely to be prematurely fractured at a weakened pinch area. The use of a pivoting gripper plug is especially advantageous on non-metallic strap which more easily suffers premature fracture resulting from pinch points than metallic strap.

Other features and advantages of the invention will be apparent from the following description and claims and are illustrated in the accompanying drawings which show structure embodying preferred features of the present invention and the principles thereof.

BRIEF DESCRIPTION OF THE DRAWINGS

In the accompanying drawings forming part of the specification, and in which like numerals are employed to designate like parts throughout the same.

DESCRIPTION OF A PREFERRED EMBODIMENT

Figure 1:
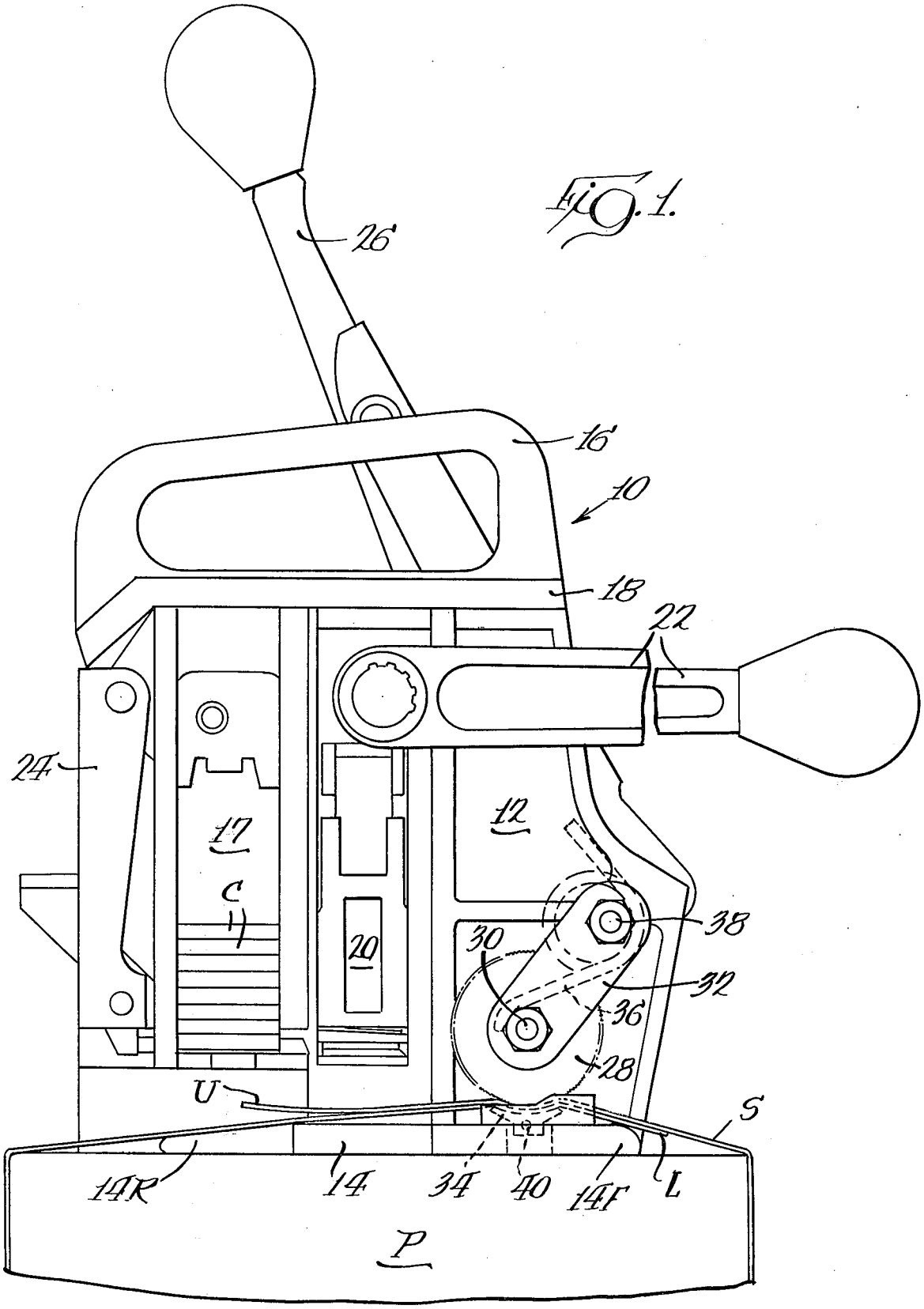
FIG. 1 is a side elevational view of the relevant parts of a strap tensioning tool shown equipped with a gripper plug and feed wheel constructed in accordance with this invention.

Referring now to the drawings, in FIG. 1, the relevant elements of a typical strap tensioning tool 10 are shown. The particular tool shown herein for purposes of illustrative disclosure corresponds generally to the tool shown in U.S. Pat. No. 3,360,017, issued to Ilmar J. Vilcins, and assigned to the assignee of the present invention, and reference may be made to that patent for further details concerning the strap tensioning tool generally designated as 10 in FIG. 1.

The tool includes a rigid main frame 12 having an elongated base 14 shown contacting a package P having a strap S looped thereabout. Opposite ends of the loop and strap S are shown extending along the top of the base 14 and constitute overlapping upper and lower strap ends U and L, respectively. The base 14 has a forward contact foot 14F and a rearward contact foot 14R.

The main frame 12 has a top 18, a carrying handle 16 and a seal magazine 17 that extends downwardly from the top and terminates above the rear foot 14R. The seal magazine 17 defines a chamber which houses the usual form of a stack of seals C for one by one delivery to the bottom of the magazine. In front of the seal magazine 17 is the sealer jaw assembly and sealer drive mechanism 20 which may be of any known type. In the tool illustrated they are operable by counterclockwise rotation of the sealer handle 22, as viewed in FIG. 1, to effect a lowering of the drive mechanism for operating the sealer jaw assembly. A seal from the stack of seals C is fed from the bottom of the seal magazine 17 to the sealer jaw assembly and sealer drive mechanism 20 by the ejector lever 24. In operation, after the strap loop is tensioned as described below, a seal is forced upon the overlapping strap ends U and L and crimp folded in place by the jaw assembly, thereby fastening the two strap loop ends together.

A feed wheel 28 is mounted from the main frame 12 for bodily movement toward and away from the upwardly facing surface region of the main frame base forward contact foot 14F. The overlapping loop strap ends U and L can then be inserted underneath the feed wheel 28 for initial strap loading of the tool. The tensioning tool has a tensioning handle 26 which includes a feed wheel rotary drive means (not shown) which may be of any known type operatively connected to drive the feed wheel in a single rotary clockwise direction to draw the upper strap end U in a loop-tightening direction, that is, to the left, as viewed in FIG. 1. In the tool illustrated, the rotary drive means acts through the feed wheel shaft 30 and is movable bodily with the feed wheel 28.

A movement of the feed wheel 28 between strap load and strap release positions is effected by a pivotal arm 32 which is pivoted on a cross-shaft 38 carried in the main frame 12 and which carries the feed wheel shaft 30 for arcuate swinging movement to approach the gripper plug 34 (illustrated in dashed lines) in the base 14F along a selected energizing angle which is inclined from the vertical.

Figure 2:
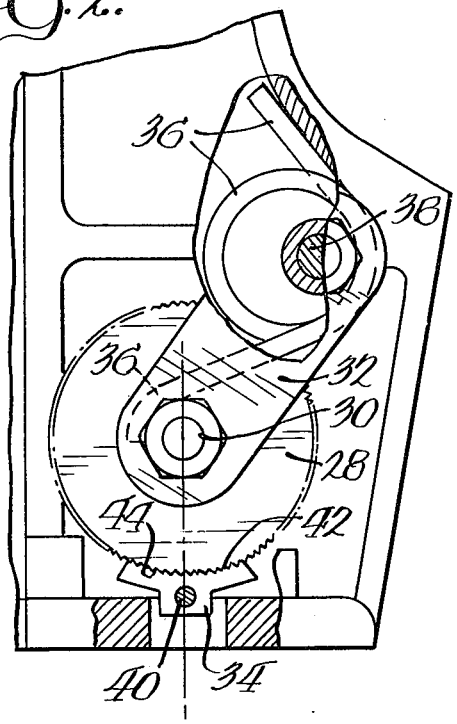
FIG. 2 is a fragmentary partial side elevational view enlarged to illustrate the construction and orientation of the gripper plug and feed wheel shown in the position assumed without strap inserted.
Figure 3:
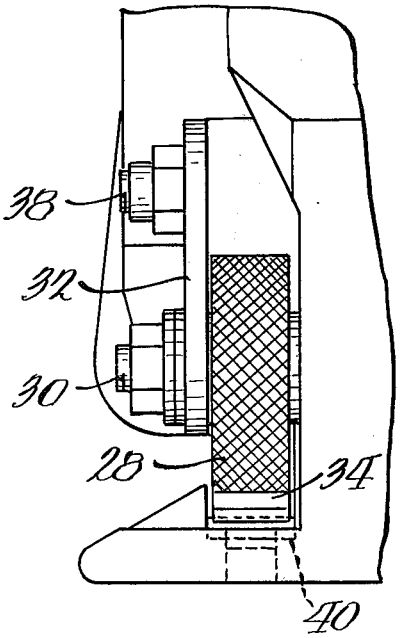
FIG. 3 is a fragmentary partial end elevational view enlarged to illustrate the construction and orientation of the gripper plug and feed wheel shown in the position assumed without strap inserted.

In accordance with the present invention, the tool is provided with a spring 36 (shown dashed in FIG. 1) for biasing the feed wheel 28 against the overlapping strap ends to keep the feed wheel 28 in contact with the overlapping strap ends during the tensioning process. For contacting and holding the bottom of the lower overlapping strap end L, a gripper plug 34 is located below the feed wheel 28 as shown in FIG. 2 and FIG. 3. The gripper plug surface is concave for receiving the lower strap end L impressed upon it by the feed wheel 28. The gripper plug shaft 40 is mounted below the feed wheel 28, and the axis of the gripper plug shaft 40 is parallel to the axis of the feed wheel shaft 30. More positive gripping action on the overlapped strap ends U and L is achieved if the surface of the gripper plug is rough or has teeth 42 and the surface of the feed wheel is rough, or has teeth 44.

Figure 4:
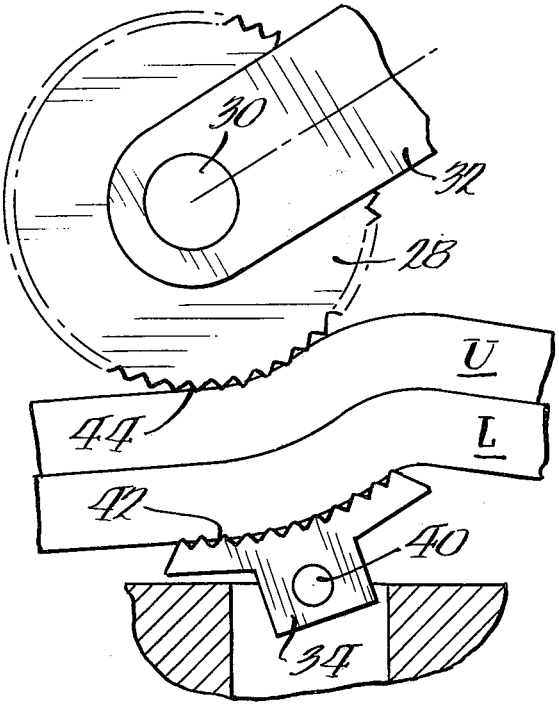
FIG. 4 is a cross-sectional partial side elevational view enlarged to illustrate the relationship between the feed wheel and gripper plug when a thick strap loop is being tensioned.

As illustrated in FIG. 4, the radius of curvature of the gripper plug 34 is substantially equal to the radius of the feed wheel 28 plus allowance for the average thickness of the overlapped loop strap ends U and L (twice the thickness of the strap S). However, the resilience of the strap allows satisfactory performance with various strap thicknesses. When the overlapping strap ends are inserted between the feed wheel 28 and the gripper plug 34, the action of the spring 36 forces the feed wheel 28 against the overlapping strap ends and forces them against the concave surface of the gripper plug 34. This causes the gripper plug 34 to rotate about the axis of the gripper plug shaft 40 to align itself so that the upper surface of the upper strap end U uniformly contacts the surface of the feed wheel 28 and so that the lower surface of the lower strap end L uniformly contacts the gripping surface of the gripper plug 34, as shown in FIG. 4. Thus, the overlapping loop strap ends are impressed between two substantially concentric surfaces: the feed wheel 28 surface and the gripper plug 34 surface. The feed wheel can thus rotate in a clockwise direction, as viewed in FIG. 4, to draw the upper strap end U in a loop-tightening direction, while constantly spreading and impressing a uniform force upon the overlapped upper strap end and lower strap end segments that lie between the feed wheel 28 surface and the gripper plug 34 surface.

Figure 5:
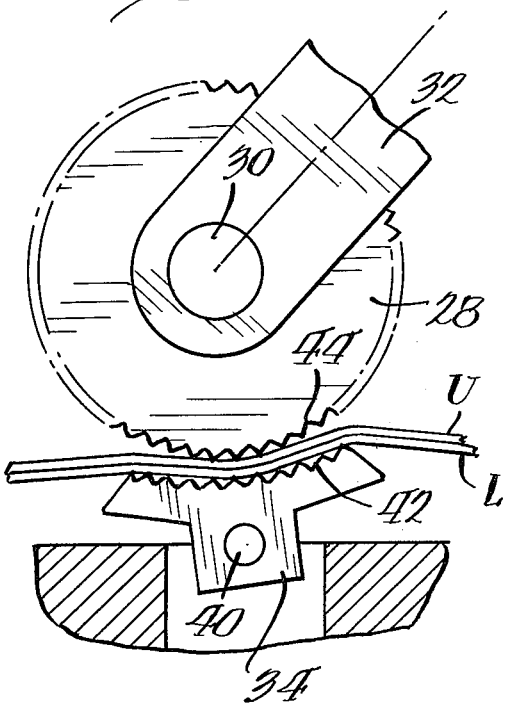
FIG. 5 is a cross-sectional partial side elevational view enlarged to illustrate the relationship between the feed wheel and gripper plug when a thin strap loop is being tensioned.

The tensioning tool 10 can accommodate strap of varying thicknesses. FIG. 5 shows a strap that is less thick than the one shown in FIG. 4. Though the tool is illustrated in FIG. 5 as designed for the thicker strap shown in FIG. 4, the curvature of the thinner strap shown in FIG. 5 substantially conforms to the arc surfaces of the feed wheel 28 and the gripper plug 34. The feed wheel 28 impresses the overlapping strap ends against a segment of part of the arc of the gripper plug 34. Though the segment does not extend the whole length of the arc surface of the gripper plug 34, the gripper plug 34 does rotate about the axis of the gripper plug shaft 40 to present a curved bearing and gripping surface to the lower strap end L. The gripper plug surface becomes aligned symmetrically with the curved surface of the feed wheel 28 about the mid-point of the arc of the surface of the gripper plug 34.

Thus, it can be seen that the pivoting of the gripper plug 34 about the gripper plug shaft 40 permits the curvature of the surfaces of the feed wheel 28 and gripper plug 34 to be aligned symmetrically about the mid-point of the arc of the surface of the gripper plug 34. Since the effective gripper surface area is greater when the surface curvatures are thus symmetrically aligned, the force impressed by the feed wheel 28 upon the overlapping strap ends is distributed over the greater area, thus producing a lesser pressure on the strap. Since the strap is subjected to lesser pressures due to a force distribution over larger surface areas, the strap is not subjected to small pinch-point areas of force which would tend to cause the strap to fracture.

It is to be understood that no limitation with respect to the specific apparatus illustrated herein is intended or should be inferred. For example, the strap tensioning tool can be manually actuated or power actuated. The overlapping strap ends can be joined to form a loop by means that do not require the use of separate clamp or folded seals. Further, the pivotal gripper plug and feed wheel can be oriented in a strap tensioning tool having a means for permitting relative movement between the feed wheel and the gripper plug with the pivotal axis of the gripper plug and the axis of the feed wheel either both horizontal or both at some other identical non-horizontal angle. Additionally, the feed wheel could be stationary and the pivotally mounted gripper plug could be movable toward and away from the feed wheel to provide for loading and releasing of the overlapping loop strap ends therebetween.

While preferred constructional features of the invention are embodied in the structure illustrated herein, it is to be understood that changes and variations may be made by those skilled in the art without parting from the spirit and scope of the appended claims.

What is claimed is:

1. A strap tensioning tool having a main frame, a base secured to the frame and adapted to contact a package to be tied with a strap loop, a strap feed wheel mounted from the main frame at a location adjacent the base, means operable to rotate the feed wheel, a gripper plug located in said base and defining a concave gripping surface, the feed wheel and gripper plug being constructed and arranged to receive overlapping ends of said strap loop, means for providing relative movement between said feed wheel and said gripper plug to permit loading and releasing of said overlapping loop strap ends, means for providing a biasing force on the overlapping strap ends between the feed wheel and gripper plug, whereby when the feed wheel is rotated the strap end contacted by the feed wheel will be drawn in a loop tightening direction, and means for pivotally mounting said gripper plug in said base location with the pivotal axis parallel to the axis of said feed wheel and with said concave gripping surface aligned symmetrically with the convex surface of said feed wheel about the midpoint of the arc of the concave gripping surface, thus permitting rotation of said gripper plug about said pivotal axis under the influence of the force on the overlapped strap ends during the tensioning action by the feed wheel, the interaction between the feed wheel surface and concave gripping surface distributing the impressed force therebetween substantially uniformly over the segment of the overlapping strap ends lying between the two surfaces to preclude pinching of the strap.

2. A tool in accordance with claim 1, including means movable bodily with the feed wheel for swinging the feed wheel toward and away from the gripper plug thereby facilitating said relative movement between the feed wheel and the gripper plug to permit loading and releasing of said overlapping strap ends.

3. A tool in accordance with claim 1, in which the concave gripping surface of said gripper plug has a radius of curvature substantially equal to that of said feed wheel.

4. A tool in accordance with claim 1, in which said concave gripping surface of said gripper plug has a radius of curvature substantially equal to the sum of the radius of the feed wheel and twice the thickness of a predetermined strap thus permitting said strap tensioning tool to accommodate strap of various thicknesses.

5. A tool in accordance with claim 1, in which said concave gripping surface of said gripper plug has a radius of curvature greater than that of said feed wheel.

6. A tool in accordance with claim 3, in which said gripper plug is metallic and presents a rough, toothed gripping surface.

7. A tool in accordance with claim 5, in which said gripper plug is metallic and presents a rough, toothed gripping surface.

8. A strap tensioning tool having a main frame, a base secured to the frame having a forefoot portion adapted to contact a package to be tied with a strap loop, a strap feed means including a feed wheel and an arm pivotally mounting the feed wheel from the main frame at a location above said forefoot portion, means operable to rotate the feed wheel, a gripper plug located in said forefoot portion of the base and defining a rough, toothed concave gripping surface with a radius of curvature substantially equal to the sum of the radius of the feed wheel and twice the thickness of the strap being formed into a tensioned loop, means movable bodily with said feed wheel for swinging the feed wheel toward and away from the gripping surface of the gripper plug to permit loading and releasing of said overlapping loop strap ends, means for spring biasing said arm for maintaining the feed wheel surface against the overlapping loop strap ends thereby forcing the strap ends against the gripper plug concave surface, whereby when the feed wheel is rotated the strap end contacted by the feed wheel will be drawn in a loop tightening direction, and means for pivotally mounting said gripper plug in said forefoot location with the pivotal axis parallel to the axis of said feed wheel and with said concave gripping surface aligned symmetrically with the convex surface of said feed wheel about the midpoint of the arc of the concave gripping surface, thus permitting rotation of said gripper plug about said pivotal axis under the influence of the force on the overlapped strap ends during the tensioning action by the feed wheel, the interaction between the feed wheel surface and concave gripping surface distributing the impressed force therebetween uniformly over the segment of the overlapping strap ends lying between the two surfaces to preclude pinching of the strap.

* * * * *